United States Patent [19]

Vorob

[11] 4,196,604

[45] Apr. 8, 1980

[54] LOCK CYLINDER

[76] Inventor: Arthur Vorob, 40 W. Hampshire Rd., Paramus, N.J. 07652

[21] Appl. No.: 841,819

[22] Filed: Oct. 13, 1977

Related U.S. Application Data

[63] Continuation-in-part of Ser. No. 709,254, Jul. 28, 1976, abandoned.

[51] Int. Cl.[2] ..... E05B 27/06

[52] U.S. Cl. ..... 70/358; 70/419

[58] Field of Search ..... 70/358, 364 A, 417, 70/419, 421

[56] References Cited

U.S. PATENT DOCUMENTS

| | | | |
|---|---|---|---|
| 2,022,070 | 11/1935 | Williams | 70/364 A |
| 3,590,615 | 7/1971 | Schultz | 70/421 |
| 3,798,938 | 3/1974 | McCullom | 70/417 |

*Primary Examiner*—Robert L. Wolfe
*Attorney, Agent, or Firm*—Feldman & Feldman

[57] ABSTRACT

A pick-proof lock cylinder is disclosed wherein a set of lock pins accommodates the cut notches of a key and biasing means are angularly disposed to the lock pins to abut and hold the ends of the pins in locking positions. Attempts to pick the set of pins are frustrated by the interference of the biasing means. The biasing means are offset to the axis of the locking pins so that upon withdrawal of the key, the biasing means keeps the locking pins in raised condition. At least one of the locking pins is in abutment with a driver pin, so that the driver pin is disposed outside the shear line of the lock cylinder in its housing, and whereupon key insertion, the lock pin driver pin abutment line is coincident with the lock cylinder shear line so as to permit rotation of the cylinder in its housing.

19 Claims, 10 Drawing Figures

LOCK CYLINDER

This application is a continuation-in-part of U.S. Ser. No. 709,254 filed July 28, 1976 and now abandoned.

BACKGROUND AND SUMMARY OF THE INVENTION

This invention relates to lock cylinders for door locks.

Conventional lock cylinders comprise a single set of pins which are moved into alignment to permit cylinder rotation by the cut notches or ridges of the appropriate key.

It is also known in the prior art to provide a lock cylinder having two sets of pins spacedly disposed 180°, so as to accommodate a key on which notches have been cut on edges disposed 180°.

In prior art lock cylinders, locking pins were in abutting relationship with driver pins, and the line of abutment was disposed below the pin shear line or cylinder rotation line without key insertion. With key insertion the locking pins and driver pins were lifted by the edge of the key so that the pin line of abutment was coincident with the pin shear line thereby permitting cylinder rotation.

While such prior art lock cylinders served their intended purpose, the lock cylinders were readily subject to picking by jiggling the pins into alignment so as to permit rotation of the cylinder. This was particularly so because the picker knew to lift the locking pins until the cylinder exhibited freedom of rotational movement.

Now there is provided by the present invention a lock cylinder wherein at least one of the locking pin-diver pin sets is disposed so that the line of abutment is above (i.e., radially outwardly disposed) the pin shear line prior to the key being inserted, and with key insertion the abutment line is then brought into alignment with the pin shear line. With some pin sets so disposed, picking attempts are frustrated.

There is further provided by the present invention means to hold the aforesaid pin sets in the above shear line disposition and to insure that the holding means positively acts in the intended manner with key insertion and removal. Also in one preferred form of the invention the aforesaid holding means is contained entirely within the cylinder itself thereby permitting replacement of conventional cylinders with the present invention, insofar as the exterior appearances are similar.

There is also provided by the present invention, a lock cylinder in which there are two sets of pins with tapered ends in abutting relationship so as to frustrate attempts to jiggle the pins into rotational alignment. The second set of pins interferes with the operation of the picking devise so in effect both sets of pins must be aligned simultaneously with one picking device at their points of abutting contact.

It is a principal object of this invention to provide a lock cylinder wherein at least one locking pin-diver pin set is disposed so that the pin set abutment line is disposed above the pin shear line prior to key insertion, and the abutment line is made coincident with the shear line with key insertion.

It is another object of this invention to provide the cylinder as immediately aforesaid wherein the means to hold the above shear line disposition of the pin set is contained within a conventionally-sized lock cylinder.

It is a further object of this invention to provide for routine acting means to hold the above shear line disposition of the pins before key insertion and with key removal.

It is also an object of this invention to provide a lock cylinder in which sets of key-actuating lock pins abut each other to frustrate attempts to pick the lock.

It is another object of this invention to provide a lock cylinder as aforesaid in which the two sets of pins are angularly disposed at an angle providing the desired interference to prevent picking.

It is still a further object of this invention to provide a lock cylinder as aforesaid in which both sets of pins must be aligned to permit rotation.

It is still a further object of this invention to provide a lock cylinder as aforesaid in which the pins are mutually biased in abutting relationship.

It is still a further object of this invention to provide a lock cylinder with two abutting pin sets as aforesaid, whereupon insertion of the correct key one set of pins drops into alignment with the pin shear line whereas the other set of pins is raised by the key into alignment with the pin shear line.

It is still a further object of this invention to provide a lock cylinder as aforesaid in which a hardened face plate protects the shear line of the pins.

Another object of this invention is to provide a lock cylinder as aforesaid which is safe and practical in use and yet is readily fabricated and of relatively inexpensive construction.

Further objects and advantages of the present invention will become apparent from the following description and the accompanying drawings which illustrate certain preferred embodiments and wherein.

Figure 7A:
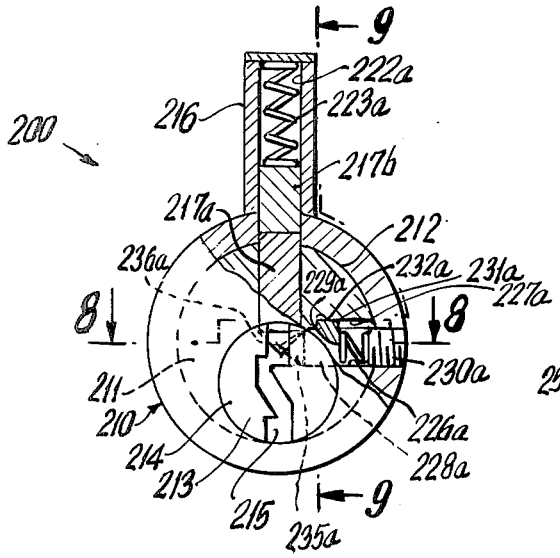
Figure 7B:
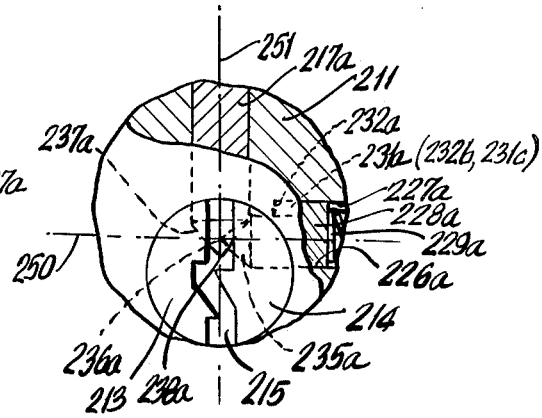
Figure 8:
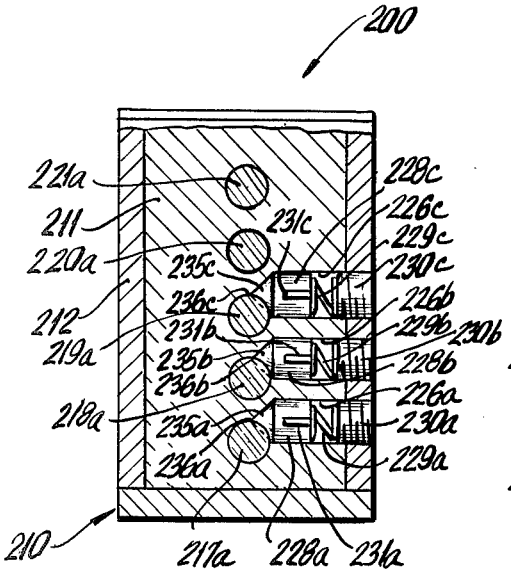

FIG. 7*a–b* is a front sectional view of an alternate embodiment of the present invention;

FIG. 8 is a top sectional view of FIG. 7 taken along line 8—8; and

Figure 9:
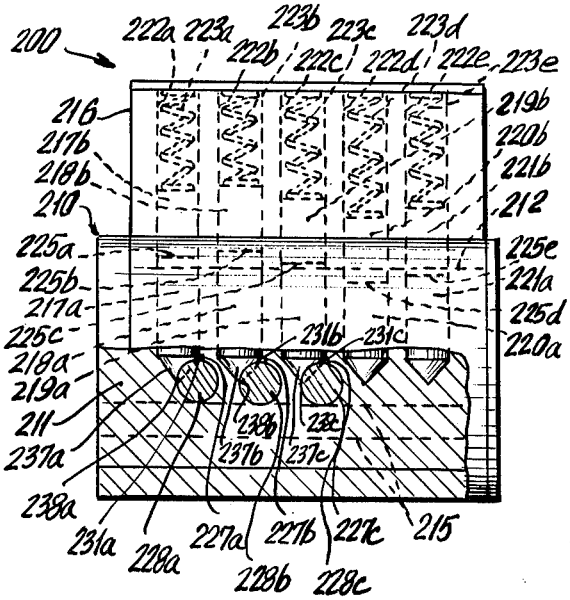

FIG. 9 is a side sectional view taken along line 9—9 of FIG. 7.

DESCRIPTION OF THE PREFERRED EMBODIMENTS

Throughout the specification, it is to be borne in mind that the terms "pin shear line" and "line of cylinder rotation" or "cylinder rotation line" refer to the rotational surface of the cylinder mounted in the housing, and such terms are to be considered synonymous. Further the terms "above" the pin shear line and "radially outwardly disposed from" the pin shear line are to be considered synonymous, and conversely the terms "below" the pin shear line and "radially inwardly disposed from" the pin shear line are to be considered synonymous.

Referring to FIGS. 1–4, there is shown the lock cylinder of this invention generally designated as numeral 10. Cylinder 10 comprises a cylindrical housing 11 being formed with a first radially extending portion 12 and a second radially extending portion 13, said portions 12 and 13 being disposed approximately 90° with respect to each other about the axis A of housing 11.

A member 14 is rotatably mounted in housing 11. Specifically, member 14 is formed with a front face 15 being formed with a key-receiving slot 16, a first outer circumferential surface 17, a second outer circumferential surface 18, a third outer circumferential surface 19, and an axial hub portion 20 for fixedly mounting a lock-actuating torque bar 21, and an inner cylindrical portion 22 for receiving key 23. A cap 24 mounts member 14 to housing 11 at one axial end, and member flange portion **14*a* mounts member 14 to housing 11 at the other axial end. Cap 24 is formed with axial hole 25 for permitting rotation of hub portion 20 and torque bar 21**.

Member 14 rotates with respect to annular surface **14*b*, surface 18, and annular surface 24*a*. A first plurality of five radially disposed holes 26*a*–26*e*, and a second plurality of three radially disposed holes 27*a*–27*c* are formed in member 14. The axes of holes 26*a*–26*e* are parallel to each other and the axes of holes 27*a*–27*c*** are parallel to each other, and the axes of the two sets or pluralities of holes are disposed 90° to each other about axis A.

Housing portion 12 is formed with a plurality of five dead-ended holes **28*a*–28*e*, and wherein holes 28*a*–28*e* are coincident with holes 26*a*–26*e***, in the lock closed position of FIGS. 1–4.

Housing portion 13 is formed with a plurality of three dead-ended holes **29*a*–29*c*, and wherein holes 29*a*–29*c* are coincident with holes 27*a*–27*c***, in the lock closed position of FIGS. 1–4.

Each of the aforesaid sets of coincident holes **26*a*–26*e* and 28*a*–28*e*, respectively abutting in series, house a compression spring 37 (typical), a first set of pins 36*a*–36*e*, and a second set of pins 37*a*–37*e*, respectively. Pin sets, 36*a*–37*a*, 36*b*–37*b*, 36*c*–37*c*, 36*d*–37*d*, and 36*e*–37*e*, vary in total length, and the pins of each set are in abutting relationship at 39*a*–39*e***. The aforesaid pin sets are in sliding relationship with the respective holes.

Each of the aforesaid sets of coincident holes **27*a*–29*a*, 27*b*–29*b* and 27*c*–29*c*, respectively, house a compression spring 41 (typical), a first set of pins 42*a*–42*c* and a second set of pins 43*a*–43*c*, respectively. Pin sets 42*a*–43*a*, 42*b*–43*b*, and 42*c*–43*c* are each of the same length, and the pins of each set are in abutting relationship at 44*a*–44*c***, respectively. The immediately aforesaid pin sets are in sliding relationship with the respective holes.

Pins **37*a*–37*e* are formed with tapered ends 40*a*–40*e*, respectively, and pins 43*a*–43*c* are formed with tapered ends 45*a*–45*c*, respectively. And under the respective forces of springs 37 and 41, tapered ends 40*a*–45*a*, 40*b*–45*b* and 40*c*–45*c* are in abutting relationship, in the lock closed position and before insertion of key 23**.

With the insertion of key 23 in slot 16, the cut ridges **23*a* (typical) engage tapered ends 40*a*–40*e*, and the corresponding pin sets are recessed to the appropriate height while springs 37 undergo compression (i.e., 40*d*, 40*e*) or initial minor compression with expansion (i.e., 40*a*–40*c*). With the correct key 23 inserted, abutting surfaces 39*a*–39*e* align with the pin shear line as defined by the rotating surfaces 18 (of housing 11) and 12*a* (of housing 12). Also, with the insertion of key 23, and simultaneously with the aforesaid alignment, key flat portion 23*b* engages tapered ends 45*a*–45*c*, the corresponding pin sets are recessed to the appropriate height while springs 41 undergo compression. With the correct key 23 inserted, abutting surfaces 44*a*, 44*b* and 44*c* recessed so as to align with the pin shear line as defined by the rotating surfaces 18 (of housing 11) and 13*a* (of housing 13). Thus, with the full insertion of key 23, member 14 is rendered free to rotate in housing 11, and with such rotation, hub 20 and torque bar 21** rotate to actuate lock opening (not shown).

It is to be noted that before insertion of key 23, the abutting interfaces **39*a*–39*c* are disposed above the aforedefined pin shear line, whereas the abutting interfaces 44*a*–44*c* are disposed below the pin shear line. With the insertion of key 23, the abutting interfaces 39*a*–39*c* are lowered in the direction towards the key into alignment with the pin shear line, and correspondingly the abutting interfaces 44*a*–44*c*** are raised in the direction from key into alignment with the pin shear line.

It is an important aspect of this invention that the abutting tapered ends of the pin sets are under a spring force, so as to interfere with the action of a lock picking device. That is, while one set of pin tapers, e.g. **37*a*–37*e*, is being manipulated by the picking device, the other set, viz., 45*a*–45*c* interferes with this attempted manipulation. Of course from the outward appearance of lock without close inspection, with portion 12 and 13 lowered, one cannot determine that there are such abutting pin tapers, nor can it be determined at what angle they are in abutment, with lock cylinder 10** door mounted in the conventional manner.

It is also within the contemplation of this invention to employ spring means on only one plurality of pins and permit gravity to drop the other downwardly disposed pins into abutting relationship. However, it is preferable to employ spring biasing means on both pluralities of abutting pins.

In the aforesaid embodiment, the two pluralities of pin sets are disposed 90° and the plane of the abutting tapered ends bisects the angular disposition at 45°. It is within the contemplation of this invention to employ other angular dispositions from about 10° to about 170°, and preferably from about 90° to 100 °. The line of taper abutment may vary, but preferably bisects the angular disposition, as depicted in the aforesaid embodiment.

It is also within the contemplation of this invention to employ the novel lock cylinder with conventional lock and bolt assemblies. That is, the torque actuating bar 21 may be of conventional design and construction so as to accommodate conventional dead bolt locking mechanisms in the well known manner. Mortise, cam and switch lock constructions are also contemplated.

It is also within the contemplation of this invention that the abutting ends of the pins be part-tapered as well as fully tapered and may further comprise flat cut faces in abutting, sliding relationship. Bevelled or rounded pin ends are also contemplated by this invention. Further, the angles of taper on abutting pins may be different although complementary.

Figure 1:
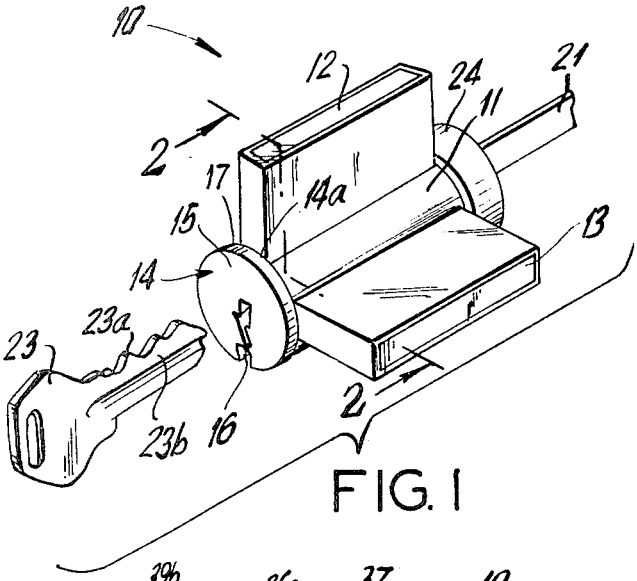
FIG. 1 is a perspective view of the lock cylinder of this invention with actuating key.
Figure 2:
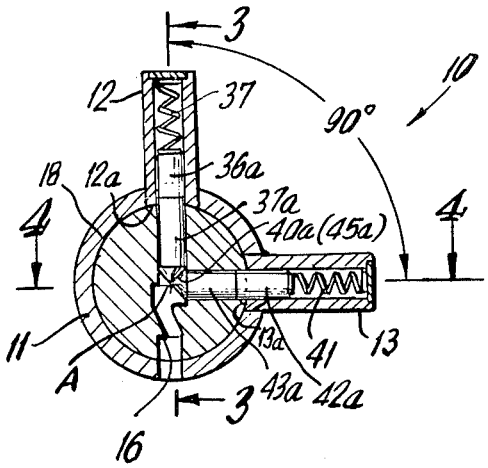
FIG. 2 is a sectional view taken along line 2—2 of FIG. 1.
Figure 3:
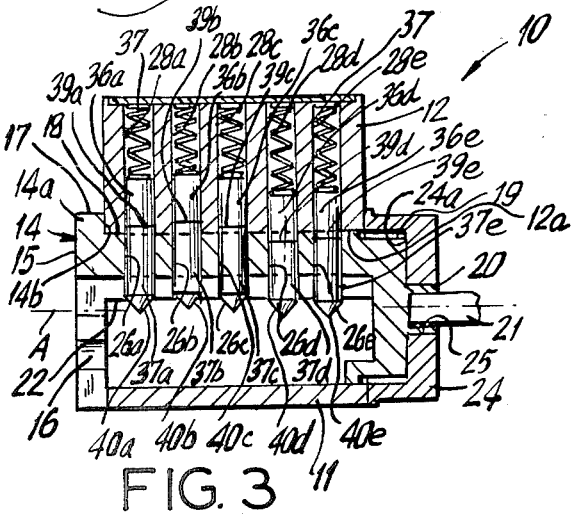
FIG. 3 is a sectional view taken along line 3—3 of FIG. 2.
Figure 4:
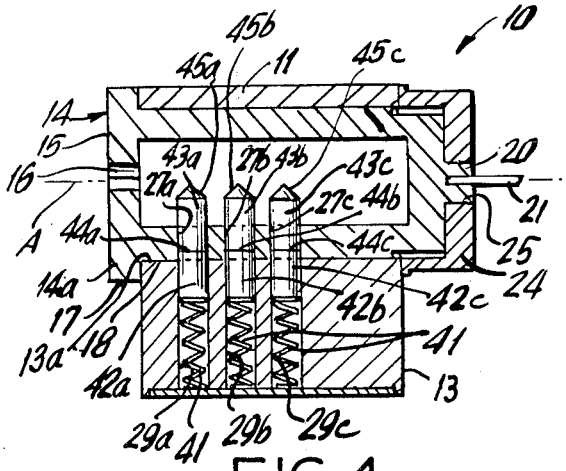
FIG. 4 is a sectional view taken along line 4—4 of FIG. 2.
Figure 5:
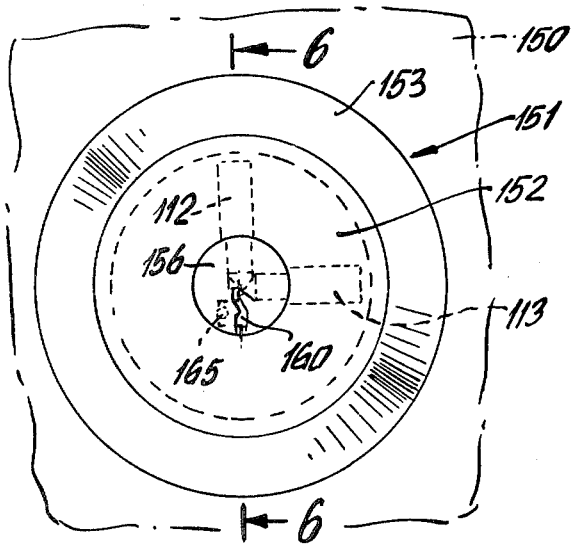
FIG. 5 is a further embodiment depicting in front elevational view the protecting mounting of the lock cylinder.
Figure 6:
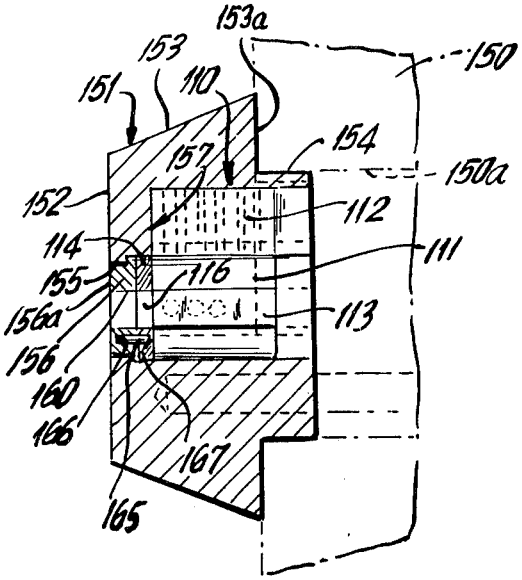
FIG. 6 is a sectional view taken along line 6—6 of FIG. 5.

In referring now to FIGS. 5 and 6, there is shown another aspect of the invention. A lock cylinder 110 of similar design and construction to the aforesaid lock cylinder 10, is mounted to door 150 by a guard, generally designated as 151. Guard 151 comprises face 152, tapered side wall 153, rear wall **153*a*, cylindrical extension portion 154 residing in recess 150*a* of door 150**, and is formed with hole 155 for receiving key plate 156 which rotates within hole 155. The interior surface generally 157, of guard 151 is formed so as to accommodate housing 111 with portions 112 and 113, as well as member 114.

Plate 156 is formed with a key slot 160 which is coincident with key slot 116 of member 114. A pin 165 having one end disposed in dead-ended hole 166 of plate 156 and the other end disposed in dead-ended hole 167 of member 114, joins plate 156 to member 114, so that with the turning of key (e.g. 23) in slots 160 and 116, plate 156 and member 114 turn together.

Guard 151 and plate 156 are both formed of hardened metal which is resistant to mechanical drilling.

The combination of cylinder 110 with guard 151 and plate 156 provides a formidable deterrent to attempts to pick the lock. For the aforesaid reasons, the cylinder frustrates attempts of lock picking devices, and attempts to drill along the pin shear lines are prohibited by face 152, as well as face 156*a* of plate 156. Specifically, insofar as plate 156 is cojoined to member 114, one cannot freely rotate plate 156 so as to expose a vulnerable portion of member 114 at which a drill could not sufficiently damage the pin structure of the respective pin sets so as to permit the cylinder to turn.

Referring to FIGS. 7*a–b*, 8 and 9, there is shown an alternate embodiment of the invention generally designated as 200. Lock cylinder 200 comprises a housing 210 of generally cylindrical tubular configuration, with cylinder 211 rotatably mounted within housing 210 at the line of rotation 212. At the front end 213 of housing 210, there is a key slot plate 214 being formed with a key hole or slot 215 to accommodate a key (not shown.)

Housing 210 is formed with a radial extending portion 216 similar in design and construction to portion 12 of the previously described embodiment. Portion 216 is formed with five cylindrical bores, 222*a–222e* for housing a series of five locking pin-driver pin sets, to wit, 217*a–217b*, 218*a–218b*, 219*a–219b*, 220*a–220b* and 221*a–221b*, respectively. All pin sets are springloaded by means of compression springs 223*a–223e*, housed within bores 222*a–222e*, respectively, so that the springs abut driver pins 217*b*, 218*b*, 219*b*, 220*b* and 221*b*, respectively.

The driver pins are in turn placed into abutment with the respective locking pins along lines of abutment 225*a–225c* for pin sets 217*a–b* through 219*a–b*, and lines of abutment 225*d–225e* for pin sets 220*a–b* and 221*a–b* respectively. It is important to note that pin abutment lines 225*a–225c* are disposed above (i.e., radially outwardly from) the cylinder rotation line, while abutment lines 225*d–225e* are disposed below (i.e., radially inwardly from) the cylinder rotation line; the former being in a novel disposition while the latter being in the conventional manner, and the reasons for such dispositions being more fully explained hereinafter.

Cylinder 211 is formed with three part-cylindrical bores 226*a–226c* each in turn being formed with recesses 227*a–227c*, respectively. Each bore, 226*a–226c*, houses a holding pin 228*a–228c*, respectively. Each holding pin in turn is spring-biased radially inwardly by a compression spring 229*a–229c*, respectively, and each holding pin-spring assembly is held within the cylinder by means of a screw threaded plug 230*a–230c*, respectively.

Each holding pin is formed with a radially-extending flange 231*a–231c*, which is slidably housed within recess 227*a–227c*, respectively, and wherein the end wall 232*a–232c* of each recess forms a stop against which the flange is in abutment so as to limit the radially inwardly extension of the holding pin into the area of the key hole.

Holding pins 228*a–228c* are each formed with tapered ends 235*a–235c* having tapered end points 236*a–236c*, respectively, and locking pins 217*a*, 218*a* and 219*a* are formed with tapered ends 237*a–237c*, respectively having tapered end points 238*a–238c*, respectively. Before key insertion, the tapered ends of the holding pins and the tapered ends of the locking pins are spring biased into the area of the key hole. The tapered ends of the holding pins are thus in abutment with the tapered ends of locking pins 217*a*, 218*a* and 219*a*, so that the abutment lines 225*a–225c* are above the cylinder rotation line, while the locking pins 220*a* and 221*a* have no holding pins, abutment lines 225*d–225e* are disposed below the cylinder rotation line. As to those abutment lines above the cylinder rotation line, the locking pins themselves block the cylinder rotation, while where the abutment lines are below the cylinder rotation line, the driver pins (220*b*, 221*b*) block the cylinder rotation. It is of course understood that the blocked cylinder rotation is a locked condition whereas an unblocked cylinder rotation permits unlocking.

Referring now specifically to FIG. 7*b* there is shown the detailed arrangement of the locking pin-holding pin abutment before key insertion. It is noted that the tapered portion 235*a* of holding pin 228*a* abuts the tapered portion 237*a* of locking pin 217*a*, so that holding pin end point 236*a* is spacedly disposed above and rearwardly (reference to key plate slot) locking pin end point 238*a*.

It is also to be noted that the axis 250 of the holding pin disposed rearwardly of axis 251 of the locking pin; the same disposition being true of each locking pin-holding pin combination. In this manner of construction the holding pins assure that the pre-sized locking pins are held in place to provide the above cylinder line blocking action, while further assuring with key insertion and key removal in particular, each locking pin-holding pin combination is correctly disposed.

With key insertion a cut edge of the key lifts the locking pin causing compression of the spring while the side of the key moves the holding pin radially outwardly under spring compression as well. The key is cut so that upon full insertion of the key certain cut edges of the key permit locking pins 217*a*, 218*a*, and 219*a* to drop (i.e., move radially inwardly) to a lower position than shown in the figures, where in said lowered position, abutment lines 225*a–225c* are made coincident with the cylinder line of rotation 212. Also with key insertion the locking pins 220*a* and 221*a* are lifted to a raised (i.e., moved radially outwardly) condition so that abutment lines 225*d* and 225*e* are also made coincident with the cylinder line of rotation 212. Thus with proper key insertion, the cylinder is then free to rotate by turning the key to achieve unlocking.

Another important aspect of this present embodiment, particularly in contradistinction to the previously described embodiment, is that the holding elements, e.g. the holding pins, springs and plugs are all housed within cylinder 211, so that the exterior configuration of the lock cylinder 200 conforms to the conventional configuration of presently commercially used lock cylinders. This is important, insofar as one may readily replace the conventional cylinder with the lock cylinder 200, and achieve the anti-picking aspects not heretofore available in lock cylinders.

It is also within the contemplation of this invention to employ a single set of abutting, angularly disposed pins, as opposed to plurality of pins although the invention most preferably employs pluralities of abutting, angularly disposed pins. It is most preferable to have some abutment lines above the cylinder rotation line while other pin abutment lines are disposed below the cylinder rotation line, thereby presenting a situation wherein the picking attempt is frustrated in not knowing which direction on pin movement will make the abutment line coincident with the cylinder rotation line.

Although specific embodiments of the invention have been described, modifications and changes may be made therein without departing from the scope of the invention as defined in the appended claims.

What is claimed is:

1. A lock cylinder comprising a housing, and a cylinder rotatably mounted in said housing at a line of rotation, and being formed with a key slot, a locking pin slidably mounted with the cylinder and housing, one end of the pin being formed to accommodate an edge of the key, means mounted in the cylinder to hold said pin in the key slot so that one end of the pin contacts the key edge with key insertion, and wherein the other end of the locking pin is disposed radially outwardly from the rotation line before key insertion, and with the key insertion, the said other end of the locking pin is brought into alignment with the rotation line thereby permitting cylinder rotation, further comprising a driver pin slideably mounted in said housing and one end thereof being in abutment with the locking pin so that the abutment line is disposed radially outwardly from the rotation line before key insertion, and the abutment line and rotation line are coincident with key insertion.

2. The lock cylinder of claim 1, further comprising spring means mounted in said housing and biasing said pins into abutment with each other, and further biasing the locking pin into contact with the holding means.

3. The lock cylinder of claim 2, said holding means comprising a holding pin slidably disposed in said cylinder and being formed with one end abutting the said one end of the locking pin, and spring means mounted in said cylinder to bias said holding pin into abutment with said locking pin before key insertion.

4. The lock cylinder of claim 3, said locking pin and said holding pin each being formed with tapered ends, said ends being in abutment before key insertion.

5. The lock cylinder of claim 4, wherein the axis of said locking pin and the axis of said holding pin are spacedly disposed but with said tapered ends being in abutment.

6. The lock cylinder of claim 5, where the axis of the holding pin is spacedly disposed behind the axis of the locking pin so that upon key insertion the key first contacts the locking pin before contacting the holding pin.

7. The lock cylinder of claim 5, wherein the said tapers are formed with end points or the respective pins and wherein the tapered end point of the locking pin is spacedly disposed from the tapered end point of the holding pin.

8. The lock cylinder of claim 3, further comprising stop means mounted in said cylinder so as to limit the extent to which the holding pin is extended into the key slot.

9. The lock cylinder of claim 1, further comprising a second locking pin spaced disposed and separately slidably housed from the first locking pin, and wherein one end of the second locking pin accommodates an edge of the key and the other end of the second locking pin is disposed radially inwardly from the insertion line before key insertion, and with key insertion both of the said other ends of the locking pin are coincident with the line to rotation.

10. A lock cylinder comprising a housing, a cylinder mounted in said housing, and a slot in said cylinder to receive a key, a first pin dispose in said housing and being aligned to accommodate an edge of the key, and a second pin disposed in said housing and being aligned to accommodate the side of said key, and being angularly disposed with respect to said first pin, the ends of said pins being tapered with each of said pins blocking rotation of said cylinder in the housing before key insertion, and said pins permitting rotation after key insertion, the end of said second pin abutting the end of said first pin before key insertion, and means to bias said second pin into abutting relationship and means to bias said first pin into abutting relationship, and with the insertion of said key in slot, the ends of said pins are spaced from each other by said key, whereby the abutting tapered pin ends block picking action of either pin end.

11. The lock cylinder of claim 10, further comprising a plurality of first pins and a plurality of second pins in abutting relationship.

12. The lock cylinder of claim 11, further comprising a plate covering the line of rotation between said housing and said portions.

13. The lock cylinder of claim 12, wherein said plate is formed with a slot which is approximately coincident with the said key slot.

14. The lock cylinder of claim 12, further comprising means to join a portion of said plate to the rotatable portion of said housing so that upon rotation of said key, the plate and rotatable housing portion rotate together.

15. The lock cylinder of claim 13, wherein the first and second pluralities contain different number of pins.

16. The lock cylinder of claim 13, wherein the axes of said first pins are coaxial with the center line of said key slot.

17. The lock cylinder of claim 12, each of said pins comprising two pins in abutting relationship, means to bias said two pins into abutting relationship together and into abutting relationship with the other two pins at said tapered ends, further comprising the first two pins being moved in the direction towards said key by said key and the second two pins being moved in the direction away from said key by said key, so as to permit rotation of said cylinder in said housing, along a line of rotation.

18. The lock cylinder of claim 17, the first two pins, abutting at a line disposed above the line of rotation and the second two pins abutting at a line below the line of rotation before key insertion, and with key insertion the edge of said key being notched so as to permit the first two pins to be lowered so that the first line of abutment is aligned with the line of rotation, and the side of said key raises the second two pins so that the second line of abutment is raised into alignment with line of rotation, said alignments being made at the same time.

19. The lock cylinder of claim 10, said pin ends being spaced from the bottom of the key slot.

* * * * *